United States Patent [19]

Shimura

[11] Patent Number: 4,708,457

[45] Date of Patent: Nov. 24, 1987

[54] SEMI-CONDUCTOR MOUNTING MEMBERS FOR SHEET-FEEDING GUIDE PLATES AND ROLLERS

[75] Inventor: Shoichi Shimura, Yokohama, Japan

[73] Assignee: Canon Kabushiki Kaisha, Tokyo, Japan

[21] Appl. No.: 929,821

[22] Filed: Nov. 13, 1986

[30] Foreign Application Priority Data

Dec. 11, 1985 [JP] Japan ..... 60-278486

[51] Int. Cl.[4] ..... G03G 15/00

[52] U.S. Cl. ..... 355/3 TR; 355/3 SH

[58] Field of Search ..... 355/3 SH, 3 TR, 14 SH

[56] References Cited

U.S. PATENT DOCUMENTS

| | | | |
|---|---|---|---|
| 4,055,380 | 10/1977 | Borostyan | 355/3 TR |
| 4,396,273 | 8/1983 | Matsuyama et al. | 355/3 TR |
| 4,415,254 | 11/1983 | Nishikawa | 355/3 TR |
| 4,491,407 | 1/1985 | Mitsuyama et al. | 355/3 TR |

FOREIGN PATENT DOCUMENTS

| | | | |
|---|---|---|---|
| 91364 | 5/1985 | Japan | 355/14 SH |

*Primary Examiner*—William H. Beha, Jr.

*Attorney, Agent, or Firm*—Fitzpatrick, Cella, Harper & Scinto

[57] ABSTRACT

This invention provides an apparatus for feeding a flexible, sheet-like transfer medium which comprises an image carrier for carrying a transferable toner image, transfer means for transferring the toner image to the transfer medium by exposing it to an electric charge, guide means arranged to guide the transfer medium to be fed, and a semi-conductive support member for supporting the guide means on an electrically-grounded system body so as to electrically connect the guide means and the body. The apparatus of this invention is capable of preventing the formation of transfer voids and toner smudges on the transfer medium such as might be caused by the leakage of electric charge and the phenomenon of floating toner clinging to the medium.

7 Claims, 8 Drawing Figures

SEMI-CONDUCTOR MOUNTING MEMBERS FOR SHEET-FEEDING GUIDE PLATES AND ROLLERS

BACKGROUND OF THE INVENTION

1. Field of the Invention

The present invention relates generally to an image forming system such as a copying machine, a printer or the like, and more particular to apparatus for feeding a flexible, sheet-like transfer medium, and which is incorporated in an image forming system adapted to expose the transfer medium to an electric charge.

2. Description of the Prior Art

It has heretofore been well known that an image forming system is usually arranged in such a manner that a flexible, sheet-like transfer medium is brought into contact with or in close proximity to the toner image which is electrostatically formed on an image carrier such as an electrophotographic light-sensitive member, and that the transfer medium is exposed to an electric charge of a polarity opposite to that of the toner of the toner image, such exposure being effected by a transfer charger disposed close to the outer periphery of the light-sensitive member, so that the toner image is transferred to the transfer medium.

In general, such an image forming system is constructed so that a plurality of metal plates are disposed as guide plates having a suitable gap therebetween in the vicinity of the transfer charger and the transfer medium is fed, through the gap between the guide plates, to a transfer section which includes the transfer charger. Therefore, while the transfer medium is being fed, although the leading end of the medium reaches the position of the transfer charger, the trailing end portion of the medium occasionally remains within the gap in contact with the guide plates which are made of electrically-conductive metal.

In this state, since the transfer medium is exposed to an electric charge by the transfer charger as described above, when humidity is high, the level of resistance of the transfer medium tends to decrease, and thus electric charge leaks from the transfer charger to the guide plates through the transfer medium. If the guide plates are grounded, transfer voids are often formed in the toner image on the transfer medium by the leakage of the electric charge. If the guide plates are allowed to float electrically with respect to the other components, electric charge is accumulated within the guide plates causing floating toner to cling to the plates. Accordingly, there is a risk of the subsequent transfer medium being stained with such toner or the image forming system being caused to malfunction by the noise generated when the guide plates discharge the accumulated electric charge.

On the other hand, when humidity is low, if the guide plates are allowed to float electrically, the electric charge accumulated by the physical friction between the transfer medium and the guide plates will occasionally give rise to stains on the transfer medium or to system malfunction.

In order to eliminate such disadvantages, the following methods have heretofore been proposed. In one typical method, a suitable level of bias voltage is applied to the guide plates which are allowed to float electrically by known means. In another typical method, the guide plates are grounded via a voltage-regulation device or a resistor. However, these respective prior-art methods need an additional mechanism, together with associated wiring and safety measures for the protection of operators as occasion demands. Thus, neither of these prior-art proposals can be considered as a satisfactory solution when factors such as space and cost are taken into account.

SUMMARY OF THE INVENTION

Accordingly, the present invention provides an apparatus for feeding a flexible, sheet-like transfer medium comprising:

- an image carrier for carrying a toner image to be transferred onto the flexible, sheet-like transfer medium;
- transfer means for transferring the toner image onto the flexible, sheet-like transfer medium by exposing it to an electric charge;
- guide means arranged to guide the transfer medium to be fed; and
- a semi-conductive support member which is arranged to support the guide means on a grounded system body, so as to permit electric charge to travel between the guide means and the system body.

The above and other objects, features and advantages of the present invention will become apparent from the following description of the preferred embodiments thereof, taken in conjunction with the accompanying drawings.

DESCRIPTION OF THE PREFERRED EMBODIMENTS

Figure 1:
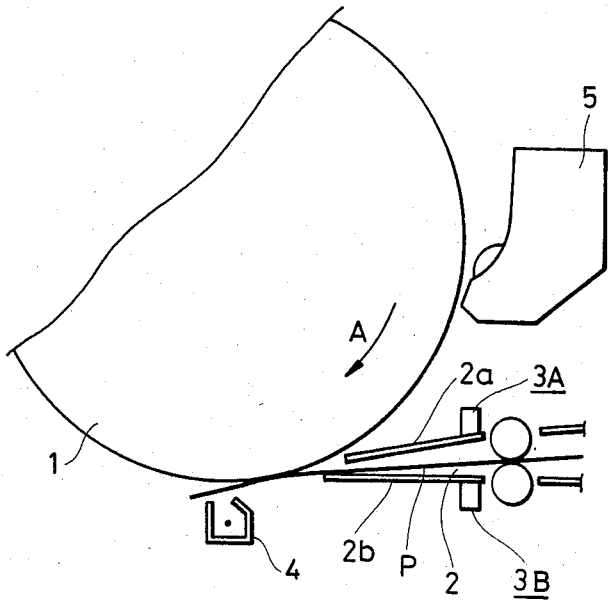
FIG. 1 is a diagrammatic side elevational view of a first preferred embodiment of the present invention showing in part a transfer section and its associated components incorporated in an image forming system.

FIG. 1 diagrammatically illustrates the first preferred embodiment of the present invention in which guide plates are disposed on the upstream side of a transfer section (on the right side as viewed in the Figure) within an electrophotographic copying machine. As shown in FIG. 1, a drum-like photosensitive member 1 is arranged in such a manner that, while it is rotating in the direction of an arrow A, a toner image (not shown) formed by electrically-charged toner is carried on the photoconductive layer of the member 1 and the toner image is moved toward a transfer section where a transfer charger 4 is located.

An upper guide plate 2*a* and a lower guide plate 2*b* are disposed to form a guide passage 2 on the upstream side of the transfer section (on the right side as viewed in the Figure). A flexible, sheet-like transfer medium P is fed to the left, as viewed in FIG. 1, through the passage 2 and, at a location corresponding to that of the transfer charger 4, comes into contact with the toner image formed on the surface of the photosensitive member 1 so that the toner image is transferred onto the transfer medium P.

As a matter of course, in addition to the shown transfer charger 4 and the developer 5, a primary electrostatic charger, an electrostatic-latent-image forming portion, separating means, cleaning means, a predestaticizer and other compounds required for image formation are disposed around the photosensitive member 1. However, since these components do not directly concern the present invention, detailed descriptions thereof will be omitted.

In such a copying machine, the lower guide plate 2*b* forming a part of the guide passage 2 is, for example, mounted on a structure 6, such as a side plate of a grounded machine body (not shown), by means of a mounting member 3B made of an electrically-conductive plastic material. Incidentally, since the upper guide plate 2*a* and its mounting member 3A are constructed in the same manner as described above, detailed description will be omitted for the sake of simplicity.

A plastic material used to form the mounting members 3A and 3B and later-described mounting members 9*a* and 9*b* in the preferred embodiments of this invention may be selected from any one of the following groups: the group consisting of high-density, middle-density and low-density polyethylenes, crystalline polypropylene, crystalline ethylene propylene block copolymer, polybutene-1, poly-4-methylpentene-1, α-olefin copolymer and their compounds; the group consisting of polyvinyl chloride, polyvinylidene chloride and their copolymers; the group consisting of cholorinated polyethylene, ethylene-vinyl acetate copolymer, polystyrene, styrene-acrylonitrile copolymer, styrene-acrylonitrile-butadiene ternary copolymer and other styrene-based resins; the polyamid group consisting of polycaprolactam, polyhexamethylene adipic acid, polyhexamethylene sebacic amide, poly-ω-aminoundecanoic acid, poly-ω-laurolactam and their compounds; and the group consisting of polymethacrylate, polyphenylene oxide, polystyrene denatured polyphenylene oxide, polyoxymethylene, linear polyester, polycarbonate, polyphenylene sulfide, polyether sulfone, polyether ketone and polyether imide.

A semi-conductive filler may be selected from the group consisting of carbon black, carbon fiber, powdered metal, metal fiber, metal-coated glass beads, metal-coated glass fiber, and metal flakes, these compounds being used in the form of a simple substance or combination. It is a matter of course that a modifying agent may be combined with any one of the above-described plastics, as required, in order to improve its physical properties.

The portion where the lower guide plate 2*b* is mounted on the structure 6 by the mounting member 3B will be described in more detail below, with specific reference to FIGS. 1 to 3B.

Figure 2:
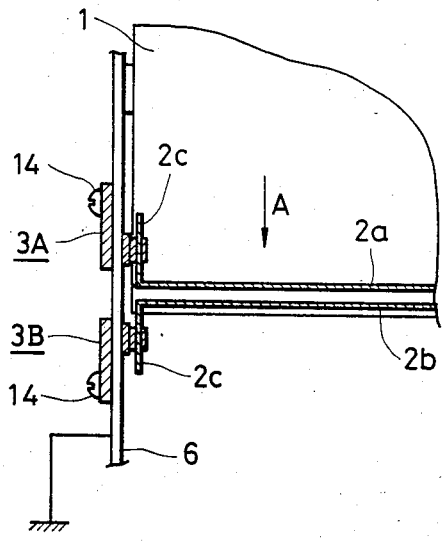
FIG. 2 is a fragmentary sectional view of the embodiment of FIG. 1 showing, on an enlarged scale, a portion on which guide plates are mounted by means of mounting members.
Figure 3A:
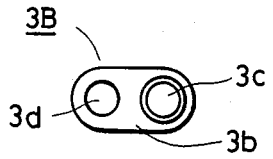
FIG. 3A is a diagrammatic top plan view of one of the mounting members shown in FIG. 2.
Figure 3B:
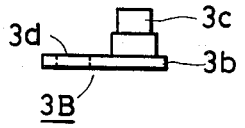
FIG. 3B is a side elevational view of the mounting member of FIG. 3A.

In the first preferred embodiment shown in FIGS. 1 and 2, the lower guide plate 2*b*, as shown in FIG. 2, is secured to the electrically-grounded structure 6 by the mounting member 3B. The configuration of the mounting member 3B is diagrammatically shown in top plan and side views in FIGS. 3A and 3B, respectively. As shown specifically in FIG. 2, an engagement projection 3*c* of the mounting member 3B extends through a hole suitably formed in the electrically grounded structure 6 and is fitted into a corresponding hole formed in a folded edge portion 2*c* of the guide plate 2*b*. Fastening means such as a bolt and a nut or a screw 14 is fitted into a hole 3*d* formed in a web 3*b* of the mounting member 3B, and is secured to the structure 6 whereby the mounting member 3B is also secured to the structure 6. This construction permits the lower guide plate 2*b* to be secured to the grounded structure 6 by the mounting member 3B which has a predetermined volume resistivity.

Figure 4:
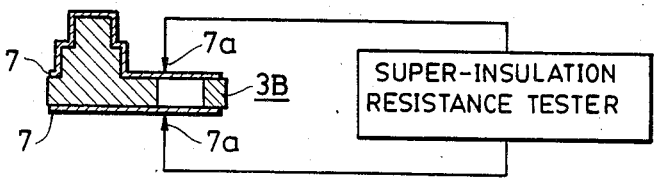
FIG. 4 is a diagram illustrating a method of measuring the volume resistivity of the mounting member shown in FIGS. 3A and 3B.

Referring to FIG. 4 which schematically shows a method of measuring the volume resistivity of, for example, the mounting member 3B, a silver paste 7 was, for experimental purposes, applied to opposite sides of different samples of the mounting member 3B and measurements were carried out while electrodes 7*a* of a super-insulation resistance tester were kept in contact with this paste 7.

Each sample of the mounting member 3 was exposed to an atmosphere of 23° C. with a relative humidity RH of 55% for twenty-four hours, and the super-insulation resistance tester was used in the same environment under conditions of an applied voltage of 100 V and a charging time of 30 seconds. The value held for one minute after completion of the electric charging operation was adopted as the measured value.

The above-described samples of the lower guide plate 2*b* and the mounting member 3 were used in the following experiments.

EXAMPLE 1

A suitable amount of carbon black was mixed with crystalline polypropylene by a twin-screw extruder, and a sample of the mounting member 3B for the lower guide plate 2*b* was formed in a predetermined shape having a volume resistivity of approximately $10^4$ Ω·cm (measured value: $8.6\times10^4$ Ω·cm) by an injection molding extruder. The thus-obtained sample of the mounting member 3 was mounted in a copying machine for measurement purposes.

EXAMPLE 2

In the same manner as described in Example 1, a sample of the mounting member 3B for the guide plate 2*b* was formed so that its volume resistivity was approximately $10^6$ Ω·cm (measured value: $1.2\times10^6$ Ω·cm). The thus-obtained sample of the mounting member 3B was mounted in the copying machine for measurement purposes.

EXAMPLE 3

In the same manner as described in Example 1, a sample of the mounting member 3B for the guide plate 2*b* was formed so that its volume resistivity was approximately $10^8$ Ω·cm (measured value: $1.7\times10^8$ Ω·cm). The thus-obtained sample of the mounting member 3 was mounted in the copying machine for measurement purposes.

EXAMPLE 4

In the same manner as described in Example 1, a sample of the mounting member 3B for the guide plate 2b was formed so that its volume resistivity was approximately $10^9$ Ω·cm (measured value: $1.9\times10^9$ Ω·cm). The thus-obtained sample of the mounting member 3B was mounted in the copying machine for measurement purposes.

EXAMPLE 5

In the same manner as described in Example 1, a sample of the mounting member 3B for the guide plate 2b was formed so that its volume resistivity was approximately $10^{10}$ Ω·cm (measured value: $2.4\times10^{10}$ Ω·cm). The thus-obtained sample of the mounting member 3B was mounted in the copying machine for measurement purposes.

EXAMPLE 6

In the same manner as described in Example 1, a sample of the mounting member 3B for the guide plate 2b was formed so that its volume resistivity was approximately $10^{11}$ Ω·cm (measured value: $1.8\times10^{11}$ Ω·cm). The thus-obtained sample of the mounting member 3 was mounted in the copying machine for measurement purposes.

EXAMPLE 7

In the same manner as described in Example 1, a sample of the mounting member 3 for the guide plate 2b was formed so that its volume resistivity was approximately $10^{13}$ Ω·cm (measured value: $5.8\times10^{13}$ Ω·cm). The thus-obtained sample of the mounting member 3B was mounted in the copying machine for measurement purposes.

EXAMPLE 8

A sample of the mounting member 3B for the guide plate 2b was formed of crystalline polypropylene alone for measurement purposes. Its volume resistivity was $2.5\times10^{16}$ Ω·cm.

The following table shows the results of the experiments conducted on the samples used as the mounting member 3B for the guide plate 2b.

TABLE

| | VOLUME RESISTIVITY OF SAMPLE OF MOUNTING MEMBER (Ω · cm) | POTENTIAL OF GUIDE PLATE AT HIGH HUMIDITY (80% RH) (V) | TRANSFER VOIDS FORMED IN TRANSFER IMAGE ON TRANSFER MEDIUM | POTENTIAL OF GUIDE PLATE AT LOW HUMIDITY (25% RH) (V) | STAINS ON TRANSFER MEDIUM |
|---|---|---|---|---|---|
| EXAMPLE 1 | $8.6\times10^4$ | −50 | Yes | +30 | No |
| EXAMPLE 2 | $1.2\times10^6$ | −110 | Yes | +80 | No |
| EXAMPLE 3 | $1.7\times10^7$ | −230 | No | +160 | No |
| EXAMPLE 4 | $1.9\times10^9$ | −400 | No | +230 | No |
| EXAMPLE 5 | $2.4\times10^{10}$ | −520 | No | +430 | No |
| EXAMPLE 6 | $1.8\times10^{11}$ | −600 | No | +620 | Some |
| EXAMPLE 7 | $5.8\times10^{13}$ | −650 | No | +800 | Yes |
| EXAMPLE 8 | $2.5\times10^{16}$ | −800 or less | No (but stains were found on transfer medium) | +1000 or more | Yes |

As can be seen from the above table, in order to prevent the formation of transfer voids and stains on the transfer medium P, the volume resistivity of the mounting member 3B of the guide plate 2b is preferably selected from within a range of $10^7$ to $10^{11}$ Ω·cm. In the same table, it can be seen that the guide plate 2b is consistently negatively charged when the humidity is high. This is because electric charge leaks from the transfer charger 4 to the guide plate 2bthrough the transfer medium P since the resistance of the medium P is lowered.

It has been confirmed from the results of other experiments that, when the potential of the guide plate 2b is −200 V or less at high humidity, transfer voids are formed; whereas, when this potential is either not more than −700 V or is +700 V or more, the transfer medium P is stained by toner. It will be appreciated that the results of these experiments substantially agree with those of the previously described experiments.

It is considered that the toner smudging observed in these experiments was formed in the following way. The toner which is positively charged within the developer 5 is negatively charged by its exposure to the transfer corona discharge and the toner which is negatively charged in this way is attracted to the guide plate 2b, the toner sticking to the guide plate 2b hence being made to cling to the transfer medium P.

Figure 5:
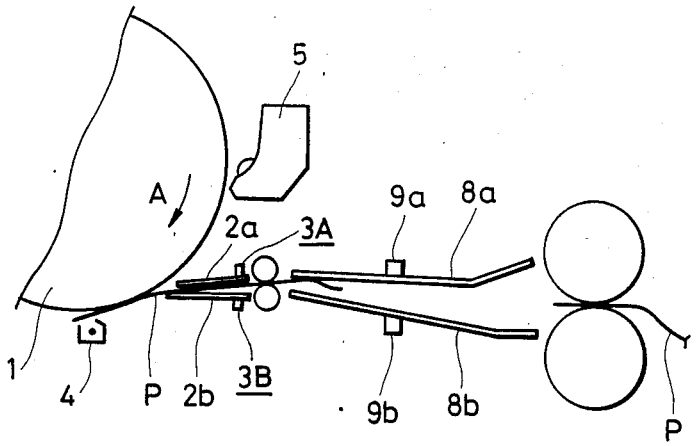
FIG. 5 is a diagrammatic side elevational view of a second preferred embodiment of the present invention showing, in part, a transfer section and its associated components incorporated in an image forming system.

FIG. 5 diagrammatically shows the second preferred embodiment of the present invention. In FIG. 5, like reference numerals are used for the sake of simplicity to denote like or corresponding elements relative to those in the above-described first embodiment.

In the second illustrated embodiment, guide plates 8a and 8b are disposed on the upstream side of the guide plates 2a and 2b, respectively, (on the right side as viewed in FIG. 5) and the plates 8a and 8b are mounted in the same manner as that of the plates 2a and 2b by electrically-conductive mounting members 9a and 9b, respectively.

In this fashion, the mounting members 3A, 3B, 9a and 9b of the respective electrically-conductive guide plates 2a, 2b, 8a and 8b with which the transfer medium P comes into contact while it is being advanced toward the transfer section are made of a semi-conductive plastic material. Thus, system malfunction and toner smudging on the transfer medium P caused by the electrical leakage from the transfer charger 4 can be positively prevented.

Figure 6:
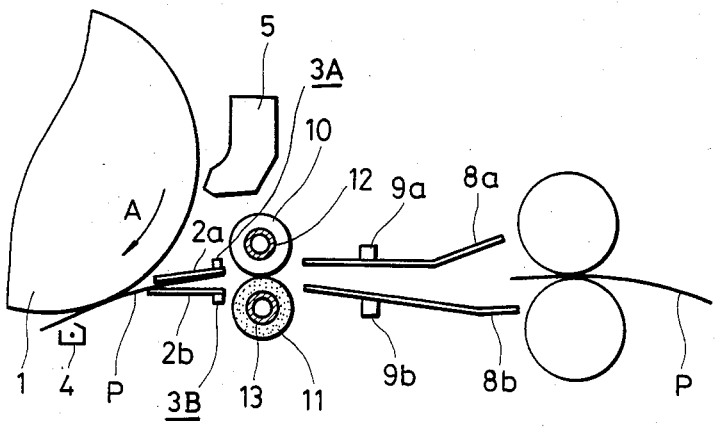
FIG. 6 is a diagrammatic side elevational view, similar to FIG. 5, of a third preferred embodiment of the present invention showing, in part, a transfer section and its associated components incorporated in an image forming system.

FIG. 6 is a diagrammatic, sectional elevation similar to FIG. 5 but showing the third embodiment of this invention incorporated in a copying machine. The third embodiment further comprises a pair of register rollers 10 and 11 which are arranged to advance the transfer medium P to the transfer section where the transfer charger 4 is located, in synchronism with the drum-like photosensitive member 1, with the register roller pair being rotatably mounted on the grounded structure 6.

The register rollers 10 and 11 made of metal such as iron, are fitted into bearings 12 and 13, respectively, and each of the bearings 12 and 13 is made of a semi-conductive plastic having the previously-described volume resistivity.

Figure 7:
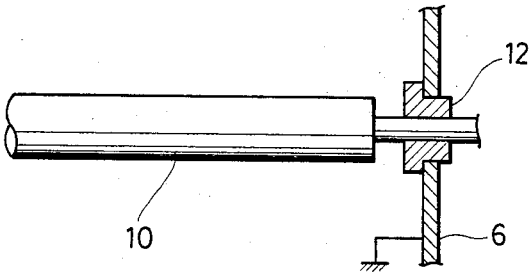
FIG. 7 is an enlarged, fragmentary sectional view taken along the axis of one of the register rollers and showing, in part, a bearing portion for the resistor roller incorporated in the third embodiment.

FIG. 7 is a diagrammatic, fragmentary sectional view taken along the axis of the roller 10, showing in part a supporting mechanism by which the roller 10 is rotatably mounted on the structure 6 by the bearing 12. In the Figure, the other roller 11 and the corresponding bearing 13 are omitted since they are also constructed in the same manner as shown in FIG. 7.

In such a construction, if either of the metal rollers 10 and 11 has an insulating layer on its surface, the above-described semi-conductive bearing may be arranged solely to receive the other roller facing the one covered with the insulating layer.

It should be noted that the embodiments described are only illustrative and the present invention may be applied to any other types of feed rollers disposed around the transfer section.

As will be readily understood by those skilled in the art, the present invention having the above-described construction and effects is capable of preventing the formation of transfer voids and toner smudges on the transfer medium, thereby achieving the high-quality transfer of toner images with a remarkably simple construction requiring neither additional specific electrical parts nor the additional wiring which normally accompanies the latter.

It is therefore evident that the present invention provides an apparatus for advancing a flexible, sheet-like transfer medium which fully satisfies the objects and advantages hereinbefore set forth. While this invention has been described in conjunction with specific embodiments thereof, it will be evident to those skilled in the art that many alternatives, modifications and variations can be adopted. Accordingly, it is intended that the following claims embrace all such alternatives, modifications and variations as fall within the true spirit and scope of the invention.

What is claimed is:

1. An image forming system comprising:

an image carrier for carrying a toner image to be transferred to a flexible, sheet-like transfer medium;

transfer means for transferring said toner image to said transfer medium by exposing the same to an electric charge;

guide means arranged to guide said transfer medium to said toner image carried by said image carrier; and a semi-conductive support member arranged to support said guide means on a grounded system body, so as to permit electric charge to travel between said guide means and said system body.

2. An image forming system according to claim 1, wherein said guide means include a guide plate forming a passage through which said transfer medium is advanced.

3. An image forming system according to claim 1, wherein said guide means include a roller disposed in said feed passage.

4. An image forming system according to claim 3, wherein said semi-conductive support member is a bearing member for said roller.

5. An image forming system according to claim 1, wherein said guide means is made of an electrically-conductive material.

6. An image forming system according to claim 1, wherein said semi-conductive support member is made of a semi-conductive resin.

7. An image forming system according to claim 1, wherein said semi-conductive support member has a volume resistivity of $10^7$ to $10^{11}$ Ω·cm.

* * * * *